US006094771A

United States Patent [19]

Egolf et al.

[11] Patent Number: 6,094,771

[45] Date of Patent: Aug. 1, 2000

[54] WC BRUSH WITH HANDLE AND BRUSH SECTIONS AND BRUSH STORAGE DEVICE

[76] Inventors: Heinz Egolf, Alpenblickstrasse 73, CH-8340 Hinwil; Dieter Widmer, Eichenweg 3, CH-8180 Bulach, both of Switzerland

[21] Appl. No.: 09/194,448

[22] PCT Filed: May 23, 1997

[86] PCT No.: PCT/CH97/00205

§ 371 Date: Dec. 22, 1998

§ 102(e) Date: Dec. 22, 1998

[87] PCT Pub. No.: WO97/45050

PCT Pub. Date: Dec. 4, 1997

[30] Foreign Application Priority Data

May 24, 1996 [CH] Switzerland ..... 1315/96

[51] Int. Cl.[7] ..... A47L 25/00

[52] U.S. Cl. ..... 15/210.1; 15/211

[58] Field of Search ..... 15/160, 164, 209.1, 15/210.1, 211

[56] References Cited

U.S. PATENT DOCUMENTS

| | | | |
|---|---|---|---|
| 2,320,967 | 6/1943 | Dunkelberger . | |
| 2,648,085 | 8/1953 | Rodgers | 15/210.1 |
| 2,666,223 | 1/1954 | Farrell | 15/210.1 |
| 2,666,224 | 1/1954 | Adams | 15/210.1 |
| 2,668,974 | 2/1954 | Jaeger | 15/210.1 |
| 3,383,158 | 5/1968 | Leland | 15/210.1 |
| 4,031,673 | 6/1977 | Hagelberg | 15/210.1 |
| 4,987,634 | 1/1991 | Weihrauch | 15/210.1 |
| 5,471,697 | 12/1995 | Daconta | 15/210.1 |
| 5,488,748 | 2/1996 | Koch | 15/210.1 |
| 5,630,243 | 5/1997 | Federico et al. | 15/210.1 |

FOREIGN PATENT DOCUMENTS

| | | | |
|---|---|---|---|
| 0295505 | 12/1988 | European Pat. Off. . | |
| 932572 | 3/1948 | France . | |
| 477136 | 12/1937 | United Kingdom . | |
| 897556 | 5/1962 | United Kingdom | 15/210.1 |
| 8700022 | 1/1987 | WIPO . | |

*Primary Examiner*—Terrence R. Till
*Attorney, Agent, or Firm*—Edwin D. Schindler

[57] ABSTRACT

The WC cleaner has a wipe (3) which takes the form of a disposable wipe which is detachably retained on handle (1), off which it can be pushed. To this end the handle (1) has an internal push-rod (14) which is disposed displaceably in a continuous longitudinal bore in handle (1). After using the WC cleaner, the wipe (3) can be pushed off by pushing the push-rod (14) inside handle (1) down so that it pushes the wipe (3) out of the device holding it on the handle. The disposable wipe (3) is flushed through the WC into the drainage system in the same way as WC paper. The storage device (7) for the disposable wipes (3) consists of a container (8) which is open at the top and has a weighted base (9). The disposable wipes (3) are stored stacked inside the container (8).

7 Claims, 6 Drawing Sheets

WC BRUSH WITH HANDLE AND BRUSH SECTIONS AND BRUSH STORAGE DEVICE

BACKGROUND OF THE INVENTION

1. Technical Field of the Invention

This invention relates to a WC cleaner comprising a handle and a disposable wipe for cleaning a WC bowl, plus an associated storage device for the disposable wipes. As a general rule, WC bowls are normally cleaned with a WC brush which is put away in a stand after use, or hung up on a hook. The user plunges the brush into the water in the WC and brushes away any faeces remaining in the bowl. For the purpose of cleaning the WC on a regular basis, a cleaning product is squirted or shaken into the bowl, and the bowl is then cleaned with the brush. The brush is then rinsed in the bowl as the WC is flushed, the water is shaken from it and the brush is then put back into its stand or hung up again. When the brush is used to wipe away traces of faeces in the WC bowl it is quite common, however, for faeces to remain trapped in the bristles of the brush, which is then put away in this state. This is certainly unappetizing and very unaesthetic. And even if the WC brush can be put away so that the actual brush part is not visible, as is the case with many stands and hanging devices, the brush still drips water and a very unappetizing pool forms in the stand or in the hanging device. This is the source of unpleasant smells and when the WC brush is taken out again, the user's attention is unavoidably drawn to this unhygienic pool.

2. Description of the Prior Art

European Patent Application No. 0,295,505 discloses a tool for cleaning or working over surfaces. It has a handle and a disposable working part, which is gripped by this handle. The disposable working part is designed as a flat cleaning cloth. The handle is placed in a stand when not in use, which also has a container that serves to accommodate the flat, unused, loosely stacked cleaning cloths. These flat cleaning cloths are designed for cleaning and working over surfaces and for applying agents to surfaces, but are not a suitable replacement for a conventional WC brush. P.C.T. Application Publication No. WO 87/00022 discloses a forceps-like cleaning device, which can be used to grip cushion-shaped disposable working elements. These disposable working elements are stored next to each other in a container. To withdraw a disposable working element, the operator first has to open the lid of the container. The forceps-like cleaning device is then used to grip a cushion-shaped disposable working element and withdraw it from the container. Because the cushion-shaped working elements are stored next to each other, the operator may find that when he pulls out one working element, the neighboring one may also be, at least, pulled out too.

SUMMARY OF THE INVENTION

The task of this invention is to provide a replacement for the conventional WC brush which overcomes the above-mentioned disadvantages so that traces of faeces are no longer put away with the brush and no pool can form underneath the brush, thereby also eliminating unpleasant smells. The replacement is to be absolutely hygienic and able to meet all hygienic requirements.

This task is solved by a WC cleaner comprising a disposable wipe and a handle with a retaining device for detachably retaining the disposable wipe, characterized in that the disposable wipe comprises a stackable paper body with a spacer at the top for spacing the stacked disposable wipes, with the disposable wipe taking the form of a hollow, truncated cone-shaped paper body, closed at the top and open at the bottom. The storage device for the disposable wipes for this WC cleaner is characterized in that it includes a tube-shaped container which is open at the top and has a weighted base, and in that the disposable wipes can be stacked inside this container, with the inner dimension of the tube-shaped container being slightly less than the outer dimension of the disposable wipes stacked inside the container so that each individual stacked disposable wipe is slightly jammed in position inside the container, and each disposable wipe can be gripped from the top and withdrawn individually from the storage device.

Advantageous exemplary embodiments of this WC cleaner with a handle and disposable wipe, and of the storage device for these disposable wipes, are shown in the drawings. The construction of these WC cleaners, the way they function and the storage device will be explained in the following description.

BRIEF DESCRIPTION OF THE DRAWING FIGURES

The drawings show:

FIG. 1: An overall view of a WC cleaner with a handle and wipe;

FIG. 2: A disposable wipe with a stud-like spacer:

a) in a vertical section, b) seen from above, c) seen from below;

FIG. 3: A partial section of a handle on the WC cleaner with a disposable wipe attached:

a) shows a second version of the WC cleaner with its handle and a disposable wipe in the process of being attached, b) shows a disposable wipe already attach firmly to the handle.

FIG. 4: A disposable wipe with a plug-like spacer:

a) in a vertical section, b) in a perspective view;

FIG. 5: A storage device for the disposable wipes in a vertical section.

DETAILED DESCRIPTION OF THE DRAWING AND PREFERRED EMBODIMENTS

Figure 1:
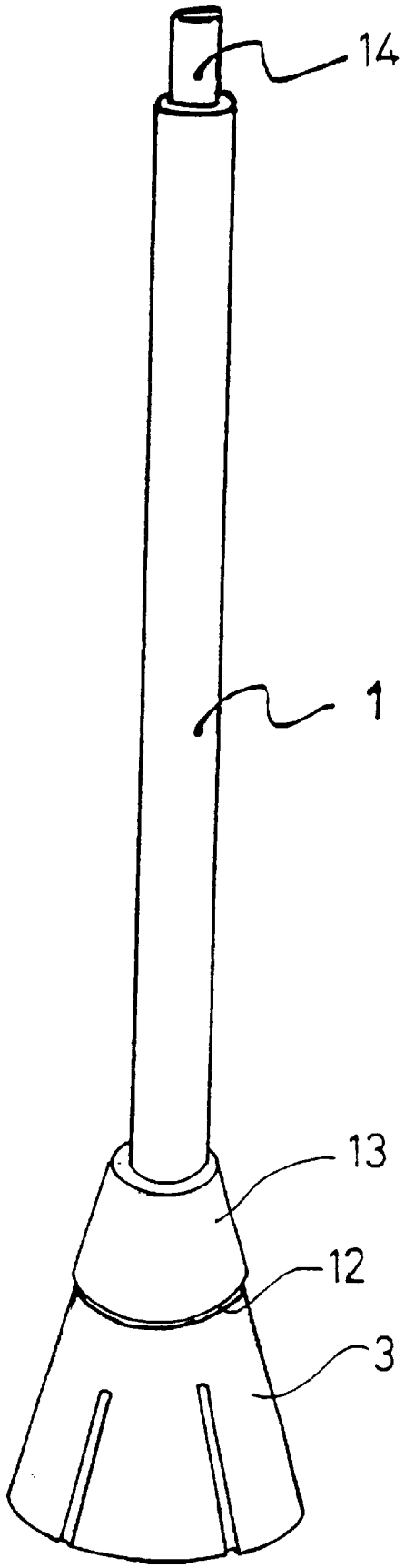

This WC cleaner is basically conceived as a replacement for a conventional WC brush and, in contrast to a WC brush, which takes the form of a one-piece utilitarian object, is designed as a two-piece utilitarian object with the actual wipe element that replaces the brush part being made from disposable consumable material. The handle of this WC cleaner is provided with means for detachably retaining the wipe element, which means will be described in detail below. FIG. 1 shows an overall view of such a WC cleaner. One can see the handle 1 with a push-rod 14 projecting from the rear end, which forms part of the means for detachably retaining the wipe, and, at the bottom, the actual wipe 3. The important thing is that the disposable wipe 3 is detachably retained on handle 1, with the retaining force being sufficient to allow the device to be used for cleaning without wipe 3 falling off involuntarily. Furthermore, there must be an easy way of pushing the disposable wipe 3 off the handle. To achieve these objectives the WC cleaner includes a handle 1 with a longitudinal bore, inside which a push-rod 14 can be longitudinally displaced. At the front end of handle 1, a bonnet element 13 is rigidly connected to handle 1. Bonnet element 13 forms a hollow cone and is designed to accommodate a disposable wipe 3 of the type shown in FIG. 2. Inside handle 1 there is a compression spring which maintains push-rod 14 inside handle 1 pressed against the rear end of the handle. To prevent push-rod 14 from falling out of the handle, it has a thread at its bottom end onto which is screwed a disc-like bolt, whose disc is bigger than the bore in handle 1. The top cone-shaped end 12 of disposable wipe 3 engages in the front part of the hollow cone that forms bonnet element 13. The conicity of the conical end of disposable wipe 3 and the hollow cone of bonnet element 13 is so small that the cone of disposable wipe 3 engages tightly in the hollow cone of bonnet element 13 and is thereby retained on handle 1. In this state the WC cleaner can be used like a conventional WC brush. After cleaning, the user presses down with one hand on push-rod 14, thereby displacing it downwards relative to handle 1. This causes the disc-shaped bolt screwed onto the bottom end of push-rod 14 to press down on disposable wipe 3, thereby pushing it out of bonnet element 13 on handle 1 and into the WC. The dirty wipe 3 is then flushed into the drainage system in the same way as WC paper. Handle 1 stays clean if it does not come into contact with the water. If it comes into contact with the water it can be cleaned by holding it in the flow of clean water as wipe 3 is flushed away. After using the WC cleaner, only handle 1 is put away. It is either hung up next to the WC or put away in a container designed for that purpose.

Figure 2A:
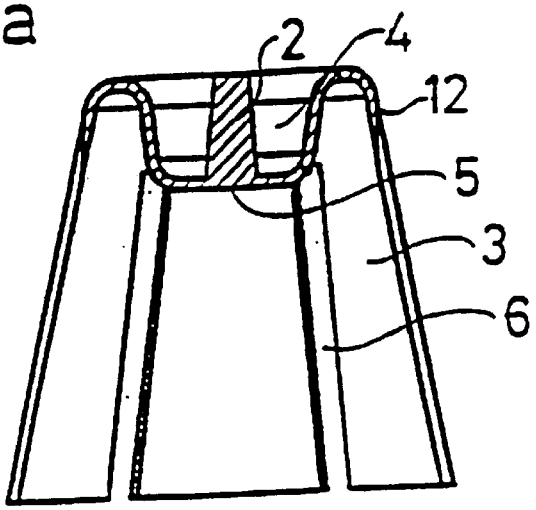
Figure 2B:
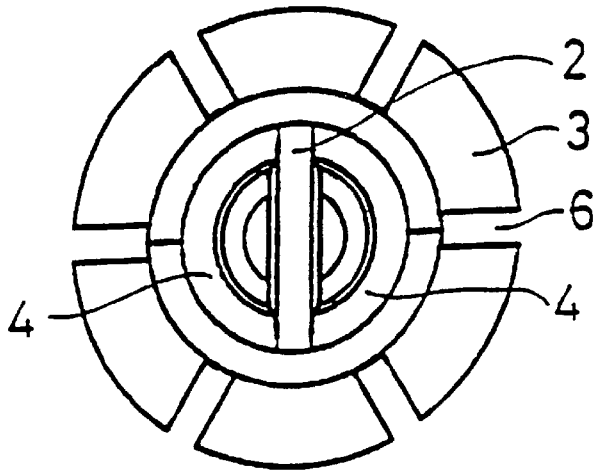
Figure 2C:
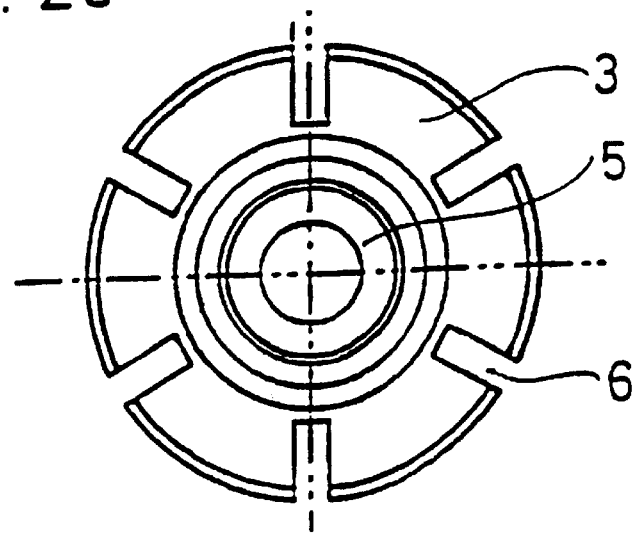

FIG. 2 shows a single disposable wipe 3, which includes a paper body which, at the top, forms a spacer 2 for spacing stacked disposable wipes 3. The disposable wipe 3 is made exclusively from cleaned, pressed recycled paper containing no binder. The advantage of this is that the disposable wipe 3 disintegrates into minuscule paper fibres as soon as it has been in contact with water for some time. Because disposable wipe 3 is pressed, however, the water penetrates the paper slowly enough to ensure that disposable wipe 3 remains stable for long enough to clean the WC bowl. As soon as disposable wipe 3 absorbs a certain volume of water, it slowly becomes limp and behaves like a cloth as it is used for cleaning. To reinforce this effect and to accelerate the disintegration of disposable wipe 3, the outer surface of disposable wipe 3 is provided with vertically running slits or groove-like weak spots 6 where the thickness of the wall of disposable wipe 3 is slightly less than the remainder of the outer surface so that damp wipe 3 tears slightly at these weak spots 6 during cleaning. A pressed paper body shaped like a truncated cone, closed at the top and open at the bottom, has proved to be a particularly advantageous shape for disposable wipe 3. Other shapes, e.g. truncated pyramid shapes, are possible too, of course. The top end of disposable wipe 3 is conically indented. In this embodiment, spacer 2 is contrived as a kind of stud which divides conical indentation 4 into two halves. FIG. 2*a* shows a vertical section through the disposable wipe. FIG. 2*b* shows the disposable wipe 3 from above and FIG. 2*c* shows it from below. In this embodiment spacer 2 serves to space disposable wipes 3 when stacked on top of each other. Stud 2 also imparts additional rigidity to disposable wipe 3 in the top conical area 12 of the paper body which engages in the hollow cone of bonnet element 13 when disposable wipe 3 is attached to handle 1.

Figure 3A:
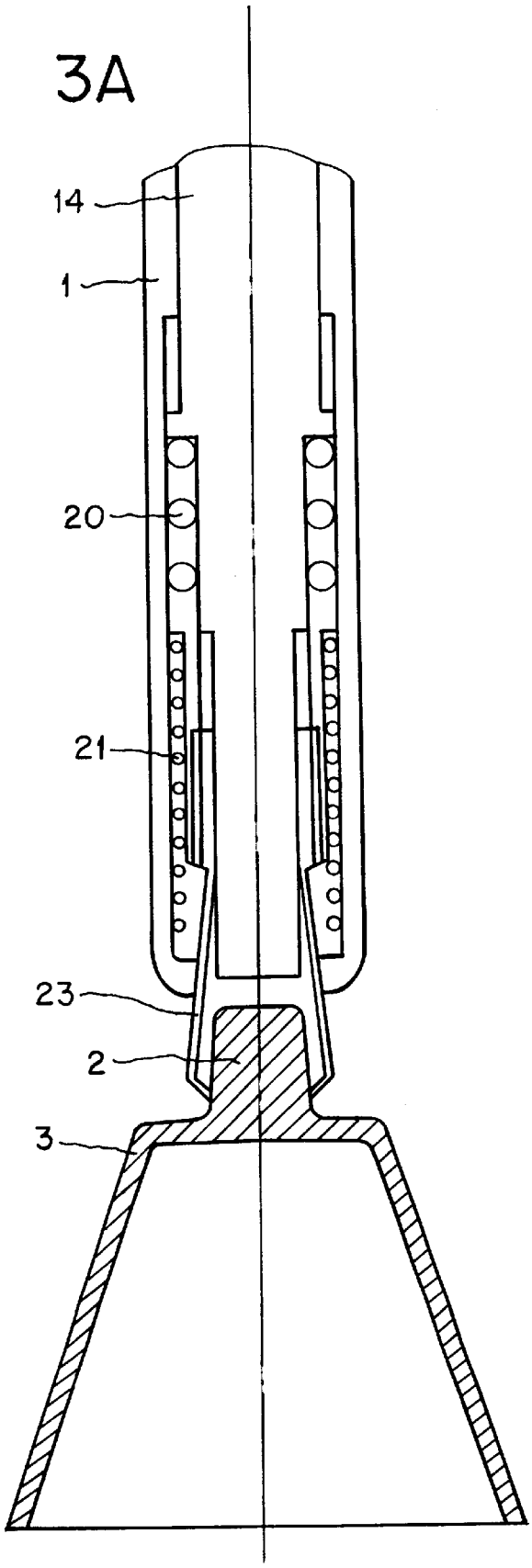
Figure 3B:
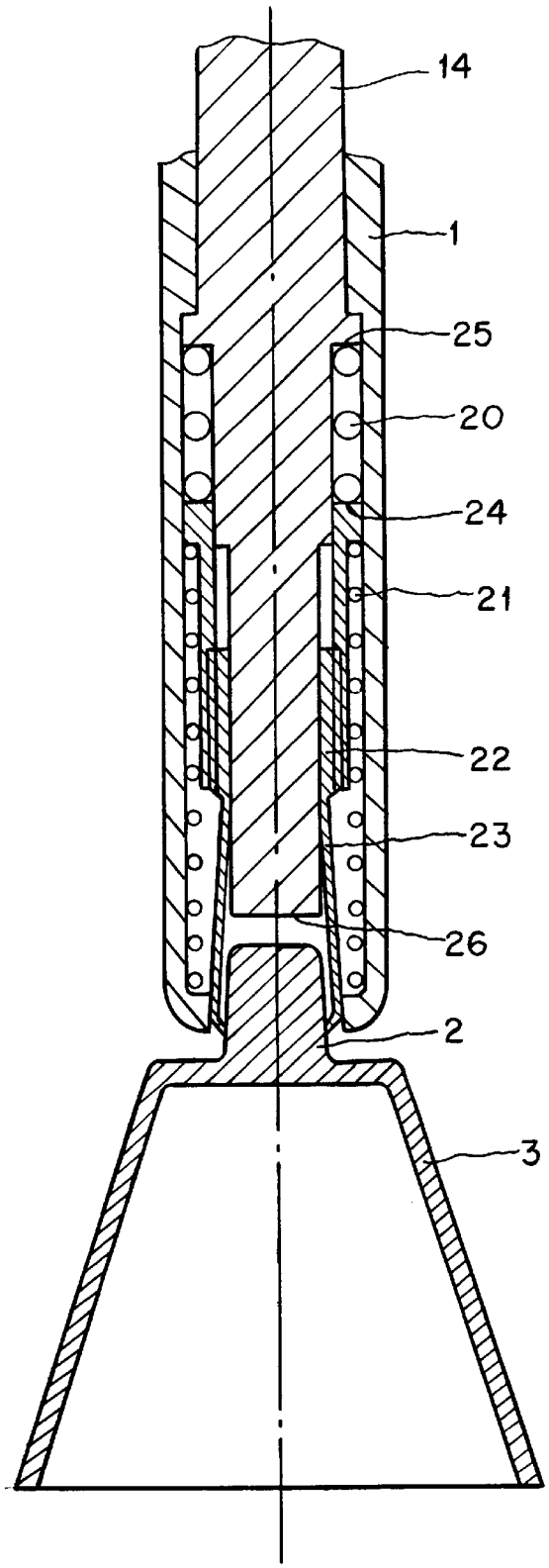

FIG. 3 shows a second version of the WC cleaner, with FIG. 3A showing handle 1 and a disposable wipe 3 in the process of being attached, whilst FIG. 3B shows a disposable wipe 3 already attached firmly to handle 1. The disposable wipes 3 which go with this WC cleaner are shown in FIG. 4. This WC cleaner also comprises a handle 1 with a push-rod 14 inside it and a gripper 22 which has several gripper fingers 23, and two compression springs 20,21 which maintain push-rod 14 inside handle 1 pressed against the rear end of the handle. Gripper 22 is made from a pliant material and in its non-activated position, the gripper fingers 23 on gripper 22 are splayed away from the central axis. In this embodiment gripper 22 has four gripper fingers, but can equally have two, three or more than four gripper fingers 23. Gripper 22 is drawn into handle 1 by the action of a first, weaker compression spring 21. A second, stronger compression spring 20, which rests on the shoulder 24 of the gripper element, presses push-rod 14 upwards. As it is drawn into handle 1, gripper fingers 23 are gradually brought closer together until they grip a disposable wipe 3. In the completely retracted state, as shown in FIG. 3B, they grip the wipe firmly. To grip a disposable wipe 3, the user therefore pushes down on push-rod 14 first, which causes the stronger spring 20 to push the gripper element downwards. This compresses the weaker spring 21, and gripper 22 is pushed out of the front end of handle 1 and splays its gripper fingers 23. These are placed over spacer 2, which, in this embodiment, takes the form of a stump shape projecting upwards in the axial direction, and push-rod 14 is then slowly drawn back by the force of springs 20,21. Gripper fingers 23 come together until they grip disposable wipe 3 firmly. The WC cleaner can now be used to clean the WC bowl. After cleaning, the user presses down on push-rod 14, causing gripper 22 to project out of handle 1 and splay its fingers 23, thereby dropping the dirty disposable wipe into the bowl to be flushed away. If disposable wipe 3 remains attached to gripper fingers 23, push-rod 14 can be pushed further down handle 1. As soon as the weaker spring 21 is completely compressed, the stronger spring 20 is compressed, too. As a result, push-rod 14 is pushed through gripper fingers 23 to the bottom end of handle 1 and if disposable wipe 3 is still attached to gripper fingers 23, it can be pushed off the gripper fingers by the bottom end 26 of the push-rod.

Figure 4A:
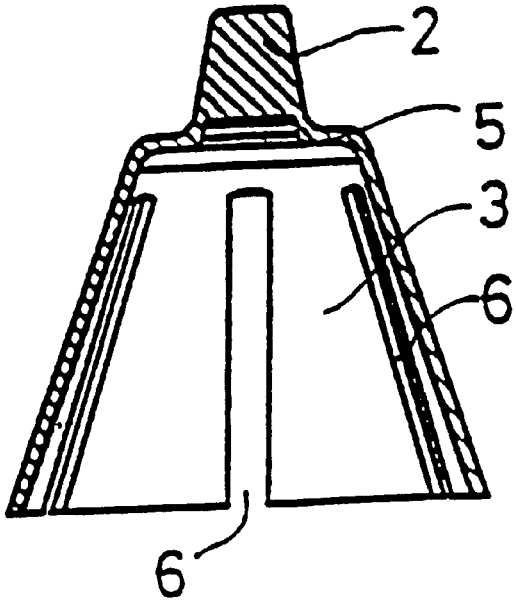
Figure 4B:
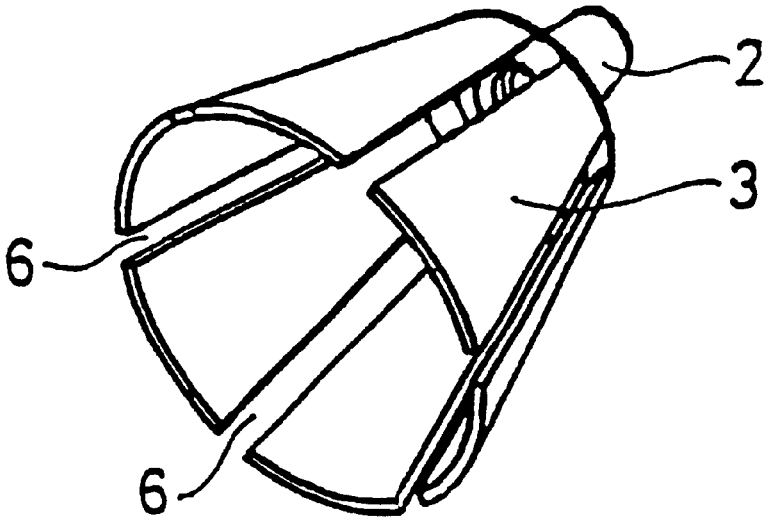

In the embodiment of the disposable wipe 3 shown in FIG. 4, disposable wipe 3 comprises a truncated cone-shaped paper body, closed at the top and open at the bottom, with slits 6 in its outer surface. The top end of disposable wipe 3 is flat and spacer 2 projects upwards in an axial direction from the center of the top end. This spacer 2 is shaped like a stump and fulfils two functions. On the one hand it forms the coupling element for attaching handle 1, and, on the other hand, this spacer 2 spaces the disposable wipes 3 when stacked. FIG. 4*a* shows a vertical section through this disposable wipe. FIG. 4*b* shows a perspective view of disposable wipe 3.

Figure 5:
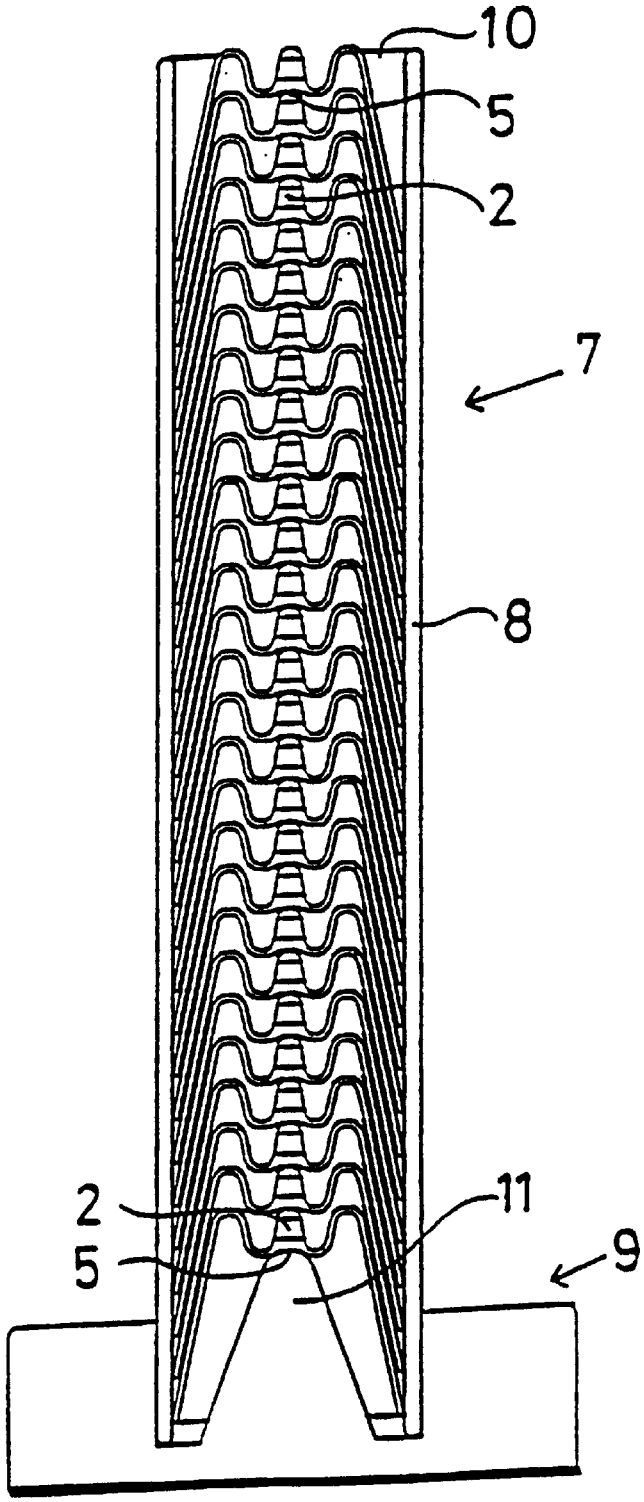

To ensure easy, practical handling of this WC cleaner, the disposable wipes 3 of the invention are stacked inside a storage device 7. FIG. 5 shows a storage device 7 filled with disposable wipes 3. The storage device 7 consists of a container 8 that is open at the top and attached to a base 9 at the bottom end. Base 9 has a cone-shaped raised portion 11 inside container 8 which serves to accommodate the disposable wipes 3 stacked in container 8. The horizontal cross-section of container 8 of storage device 7 is adapted to the outer shape of the disposable wipes 3 for stacking. For the disposable wipe 3 described above, the associated tube-shaped container 8 has a circular cross-section. For pyramid-shaped disposable wipes, the associated container 8 has a quadratic or rectangular cross-section. The inner diameter of the tube-shaped container 8 is slightly smaller than the outer dimension of the disposable wipes 3 to be stacked inside container 8. This ensures that each individual stacked disposable wipe 3 is slightly jammed in place inside container 8. To prevent the disposable wipes 3 from jamming inside each other uncontrollably as they are stacked up, so that they cannot then be picked up individually from the stack, the disposable wipes 3 are kept apart at a defined distance by spacer 2. When the disposable wipes 3 are stacked on top of each other, the flat inside portion 5 of the top end of each disposable wipe 3 rests on the spacer 2 of the next disposable wipe down 3. The disposable wipe 3 at the bottom of the stack rests on the cone-shaped raised portion 11 of base 9. To attach a disposable wipe 3 onto handle 1, the clamping or bonnet device on handle 1 grips the uppermost disposable wipe 3 or is placed over it, and pressed lightly downwards. Because spacers 2 between the stacked disposable wipes 3 form a sort of rigid axis which rests on the top of the cone-shaped raised portion 11 of base 9, the stacked disposable wipes 3 are not pressed together when handle 1 is pushed down, and hence they cannot jam inside each other. Because the diameter of container 8 is slightly less than the outer dimensions of disposable wipes 3, the latter are held slightly jammed in position inside container 8. When the uppermost disposable wipe 3 is lodged on or gripped by handle 1 and is withdrawn, the loosely stacked disposable wipes 3 underneath remain in place inside storage device 7 because of the friction against the inside container wall.

Handle 1 can either be hung from the edge 10 of storage device 7 by means of a hook contrived on handle 1, or a suitable bore for accommodating handle 1 can be provided in base 9. This ensures that the utensils required to use this WC cleaner can be stored in the smallest possible space in hygienically irreproachable conditions.

This WC cleaner can be designed as a disposable product in a set with a handle 1, disposable wipes 3 and a storage device 7. The storage device 7 and the handle 1 are designed as re-usable products whilst the disposable wipes 3 are manufactured and sold in refill packs for storage device 7.

The variations of the WC cleaner shown here allow absolutely hygienic cleaning of WC bowls using a disposable wipe. The handle, which can be cleaned without the user having to dirty his hands, meets all hygienic requirements, even when not in use. No parts which come into contact with faeces or dirty water are removed from the WC and put away elsewhere, as is the case with prior art WC brushes. This WC cleaner with disposable wipe is inexpensive to manufacture and is easy and safe to handle and use.

What is claimed is:

1. A WC cleaner, comprising:

disposable wipes having a stackable paper body with a spacer for spacing a stack of said disposable wipes, with said disposable wipes being in the form of a hollow, truncated cone-shaped paper body, which is closed at its top and open at its bottom; and, a handle with a retaining device for detachably retaining at least one of said disposable wipes.

2. The WC cleaner according to claim 1, wherein a top end of said truncated, cone-shaped disposable wipe has a conical indentation with said spacer being formed as a stud, so that the conical indentation is divided into two halves, so that when a plurality of said disposable wipes are stacked up, a flat, inner portion of the top end of each of said disposable wipes rests on top of said spacer of said disposable wipe immediately beneath therebelow.

3. The WC cleaner according to claim 1, further comprising a bonnet element rigidly connected with said handle at a front end of said handle, said bonnet element forming a hollow cone for accommodating said disposable wipes, with said disposable wipes having a cone fitting inside said hollow cone of said bonnet element, so that said handle and said disposable wipes are able to be joined together, said handle further comprising a compression spring and an internal push-rod displaceable along said handle, said internal push-rod projecting out from a rear end of said handle and displaceable toward the front end of said handle against a biassing force of said compression spring disposed in said handle, wherein said disposable wipes are able to be pushed off of said handle by said push-rod.

4. The WC cleaner according to claim 1, wherein the top end of said truncated, cone-shaped disposable wipes is flat, and said spacer projects upwards in an axial direction from a central point of its top end, with a plurality of said disposable wipes being stacked up, the flat, inner portion of the top end of each of said disposable wipes rests on top of said spacer of said disposable wipe immediately therebelow, with said retaining device for detachably retaining said disposable wipes including a spring-loaded push rod and a gripper made from a pliant material, with gripper fingers of said gripper being splayed in a non-activated state, with said gripper being capable of being drawn into said handle via said push-rod, whereupon said gripper fingers of said gripper are brought together.

5. The WC cleaner according to claim 1, wherein said disposable wipes are made as a pressed body entirely from cleaned recycled paper containing no binder, with an outer surface of said disposable wipes having running, groove-like weak points.

6. A storage device for disposable wipes for a WC cleaner, said WC cleaner including disposable wipes having a stackable paper body with a spacer for spacing a stack of said disposable wipes, with said disposable wipes being in the form of a hollow, truncated cone-shaped paper body, which is closed at its top and open at its bottom, and a handle with a retaining device for detachably retaining at least one of said disposable wipes, said storage device comprising:

a tube-shaped container having a weighted base and an open top inside of which said disposable wipes are stackable, said tube-shaped container having an inner dimension slightly smaller than an outer dimension of said disposable wipes for stacking in said tube-shaped container, so that each of said disposable wipes is pressed in position in said tube-shaped container with each of said disposable wipes being able to be gripped through the top of said tube-shaped container and individually withdrawn therefrom.

7. The storage device for disposable wipes for a WC cleaner according claim 6, wherein said weighted base of said tube-shaped container has a cone-shaped raised portion inside said tube-shaped container upon which said disposable wipes are stackable.

* * * * *